US006370345B2

(12) United States Patent
Sasai

(10) Patent No.: US 6,370,345 B2
(45) Date of Patent: Apr. 9, 2002

(54) IMAGE FORMING APPARATUS AND IMAGE FORMING METHOD EMPLOYING THE SAME

(75) Inventor: Takahiro Sasai, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/761,267

(22) Filed: Jan. 16, 2001

(30) Foreign Application Priority Data

Jan. 18, 2000 (JP) ..... 2000-008580

(51) Int. Cl.[7] ..... G03G 15/14
(52) U.S. Cl. ..... 399/101; 399/66
(58) Field of Search ..... 399/66, 101, 149, 399/313, 314, 315, 316

(56) References Cited

U.S. PATENT DOCUMENTS 5,884,121 A 3/1999 Kyung 6,006,055 A * 12/1999 Furuya ..... 399/149

* cited by examiner

*Primary Examiner*—Sophia S. Chen
*Assistant Examiner*—Hoang Ngo
(74) *Attorney, Agent, or Firm*—Hogan & Hartson, L.L.P.

(57) ABSTRACT

A predetermined level of voltage is applied to a transfer roller (26) to transfer a toner image on a photosensitive drum (22). After a predetermined number of recording sheets are made, a cleaning sequence is started wherein a voltage of −900V is applied as a cleaning voltage. Before applying the transfer voltage of 3 kV, intermediate voltage is applied once or more under the control of a control unit (30). The control unit (30) instructs the application of the voltage through an electrical circuit (32) to the transfer roller (26) based on conditions set in a memory (33) and/or information given by a machine temperature sensor (35).

12 Claims, 3 Drawing Sheets

IMAGE FORMING APPARATUS AND IMAGE FORMING METHOD EMPLOYING THE SAME

CROSS REFERENCES TO RELATED APPLICATIONS

This application claims priority under 35 USC 119 of Japanese Patent Application No. 2000-8580 filed on Jan. 18, 2000, the entire disclosure of which is incorporated herein by reference.

BACKGROUND OF THE INVENTION

1. Field of the Invention

The present invention relates to a voltage applying means for a contact-transfer member that transfers a toner image formed on a photosensitive body of an image forming apparatus onto a recording medium. The present invention also relates to an image forming apparatus equipped with a switching means to apply transfer voltage after a cleaning sequence, and an image forming method employing said apparatus.

2. Description of the Related Art

In a conventional image forming apparatus employing an electrophotographic system, especially in a segment of the apparatus where a toner image is transferred to a recording sheet, an electrostatic latent image is formed by an exposing unit on a photosensitive drum, and visualized into a toner image using a toner supplied from a developing unit. Subsequently, this toner image is transferred to a recording sheet. The recording sheet bearing the toner image is passed through a fixing unit so that the toner image is fixed to become a copy. In the image transfer section where the image is transferred from said photosensitive body, a discharging member such as a corotron, and a contact-transfer roller are used. In a system employing said contact-transfer roller, the transfer member directly touches the photosensitive body at a position where there is a gap between any two successively fed recording sheets, resulting in a contamination problem that the toner adhered to the photosensitive body or paper particles attach to the contact-transfer member. Therefore, a cleaning sequence is programmed in a control unit such that the cleaning sequence is executed after a certain number of copies are made. In the cleaning sequence, generally voltage is applied to the transfer roller in opposite polarity to the transfer voltage that is applied for transferring procedure.

However, for example, if the transfer voltage, which is applied to the contact-transfer means, is +3 kV, and the voltage used during the cleaning sequence is −900V, the voltage gap is so big when the transfer voltage is applied after a cleaning sequence that there will be some lack of uniformity in potential on the surface of the photosensitive body. The lack of uniformity generated on the surface of the photosensitive body could lead to deterioration in the quality of recorded image. If the changes in the transfer voltage is very big and too frequent in a short period of time, it could lead to the deterioration of the photosensitive body, thus influencing the life of the image forming apparatus itself.

SUMMARY OF THE INVENTION

It is an object of the present invention to solve the problem of the voltage gap when the contact-transfer is given the transfer voltage, and in particular to eliminate the influence that application of the transfer voltage after the cleaning sequence has on the photosensitive body.

According to one aspect of the present invention, there is provided an image forming apparatus including a photosensitive body, a contact-transfer member that contacts said photosensitive body, an voltage applying circuit that applies voltage to said contact-transfer member, and a controller for causing the voltage applying circuit to apply intermediate voltage to the contact-transfer member in the course of a switch from the voltage used for a cleaning sequence to the voltage used for transferring. In the cleaning sequence, the voltage applying circuit applies voltage, opposite in polarity to that used for the transferring, to the contact-transfer member for causing residual toner and paper particles on the contact-transfer member to return to the photosensitive body. By applying the intermediate voltage to the contact-transfer member prior to application of the transfer voltage, the photosensitive body surface voltage does not change steeply. Therefore, voltage of the photosensitive body is not disturbed, and good quality of printing is insured.

The control unit may cause the voltage applying circuit to apply the intermediate voltage to the contact-transfer member while the photosensitive body rotates once or twice. This eliminates the influence that application of the transfer voltage after the cleaning sequence has on the photosensitive body.

The intermediate voltage may be 0V or greater than 0V. The intermediate voltage may be applied more than once. For instance, a first intermediate voltage of 0V is applied and subsequently a second intermediate voltage greater than that is applied.

Additional objects, benefits and advantages of the present invention will become apparent to those skilled in the art to which the invention pertains from the subsequent description of the embodiment(s) and the appended claims, taken in conjunction with the accompanying drawings.

DETAILED DESCRIPTION OF THE INVENTION

While the present invention will be described in connection with a preferred embodiment thereof, it will be understood that it is not intended to limit the invention to that embodiment.

Some embodiments of an image forming apparatus to which the present invention is applied will hereinafter be specifically described with reference to the drawings.

Figure 1:
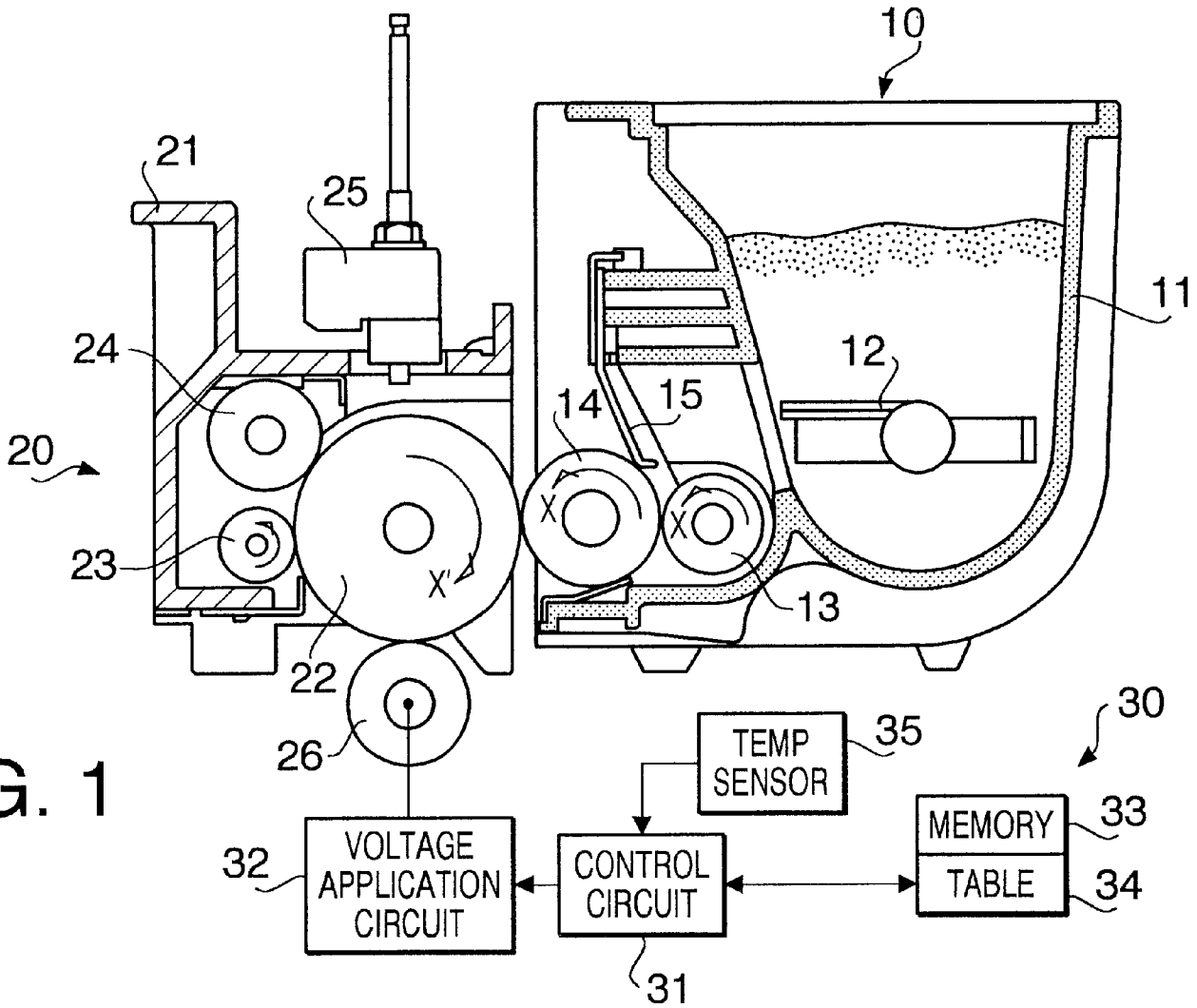
FIG. 1 is an illustrative diagram to show the structure of a photosensitive unit that is combined with a developing unit.

FIG. 1 shows an image forming apparatus having a photosensitive drum 22 and a developing unit 10, said photosensitive drum 22 located in a photosensitive unit 20 in a way such that a developing section of the photosensitive drum 22 is located opposite to a developing roller 14 of the developing unit 10. In the developing unit 10 that is located side by side with the photosensitive unit 20, the toner contained in a toner container unit 11 is agitated by an agitator 12 as it is fed toward a feed roller 13. The developing roller 14 is in friction contact to the feed roller 13 and these two rollers rotate in the same direction as indicated by the arrow X. While the toner is negatively charged between the feed roller 13 and the developing roller 14, the toner is adhered to the developing roller 14 in a thin layer. Once the toner is adhered to the surface of the developing roller 14, it is formed as an even, thin layer by means of a blade member 15, then exposed before it meets the photosensitive drum 22, and adhered to an electrostatic latent image at a position where the toner touches the photosensitive drum 22, which rotates in the direction of the arrow X'.

A photosensitive unit 20, which is combined with the developing unit 10, is composed of a photosensitive drum 22, which functions as a photosensitive body and rotates at a predetermined rate driven by a driving mechanism (not illustrated) mounted on the frame 21, and a contact-transfer roller 26 which transfers toner image formed on the photosensitive drum 22 to a recording medium. The contact-transfer member may take the form of a brush or a blade. Around the photosensitive drum 22 are positioned the transfer roller 26, a memory removing member 23, charging roller 24, and an exposing unit 25 in the rotational order of the photosensitive drum 22. After the photosensitive drum 22 are uniformly charged, for example up to −700V, by the charging roller 24, an electrostatic latent image, for example of minus several dozens of volts, is formed on the surface of the photosensitive drum 22 with a light beam emitted from the exposing unit 25. On the electrostatic latent image is placed a toner from the developing roller 14, for example of −350V, to create a toner image, which will be transferred to a recording sheet being fed to the image transfer section by applying a predetermined transfer voltage from the back of the recording sheet by means of the transfer roller 26.

The residual toner on the photosensitive drum 22, after the toner image has been transferred to the recording sheet in said image transfer section, is stirred by a roller-type memory removing means, which may take the form of a brush or a sponge, so that the adhesion strength of the toner to the photosensitive drum is reduced. Then the rotating charging roller 24, which is like a brush in shape, further stirs the photosensitive drum, and uniformly charges the whole surface of the photosensitive drum to make it ready for the next exposure. In the apparatus described here as a preferred embodiment is what is called a cleaner-less apparatus, in which cleaning means are not used to remove residual toner and other things on the photosensitive drum after the toner image is transferred on a recording sheet. Instead, after the memory removing member 23 and the charging member 24 reduce adhesive strength of the toner, the toner is recollected by the developing roller 14 into the developing unit 10 to be re-used mixed with newly supplied toner.

Figure 2:
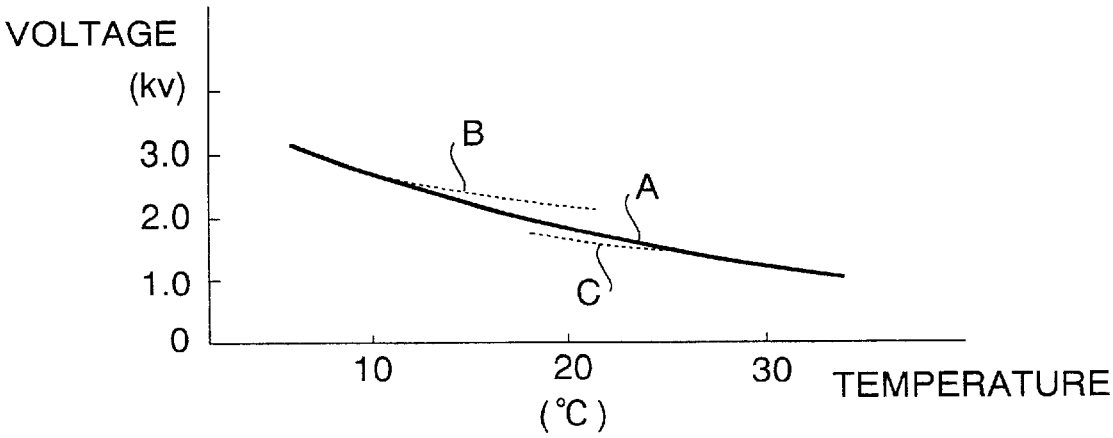
FIG. 2 illustrates a graph to show temperature characteristics of the voltage applied to a transfer roller.

It is known that the voltage applied from the transfer roller 26 to transfer the toner image on recording sheets from the photosensitive drum 22 is influenced to a great extent by temperature conditions within the image forming apparatus, as is shown in the graph of FIG. 2. For example, if the temperature of the inside of the image forming apparatus is 20° C., 2 kV is appropriate, while for 40° C., 1 kV, and for less than 10° C., 3.5 kV is necessary. In the graph of FIG. 2, at the temperature under 20° C., the control should be done in accordance with the curve B, and above 20° C., the control should be done in accordance with the curve C. The above-mentioned two curves may be combined to make a curve A, making it possible to set a single control condition over a wide range of temperature.

A gap is made between each two successive recording sheets so that the photosensitive drum 22 touches the transfer roller 26 directly at the gap between recording sheets. As a result, the toner adhered to the photosensitive drum 22 is transferred to the transfer roller 26, causing contamination. In addition, paper particles and other particles floating inside the apparatus are adhered to the transfer roller 26, thereby tainting the back of the recording sheets, and causing uneven distribution of the voltage applied from the back of the recording sheets. This results in irregular transfer. Therefore, in the illustrated image forming apparatus, a cleaning sequence is applied to the transfer roller 26 to transfer the negatively charged toner, paper particles and others back to the photosensitive drum 22 from the transfer roller 26 whenever a predetermined number of recorded sheets are made or when the recording starts.

Figure 3:
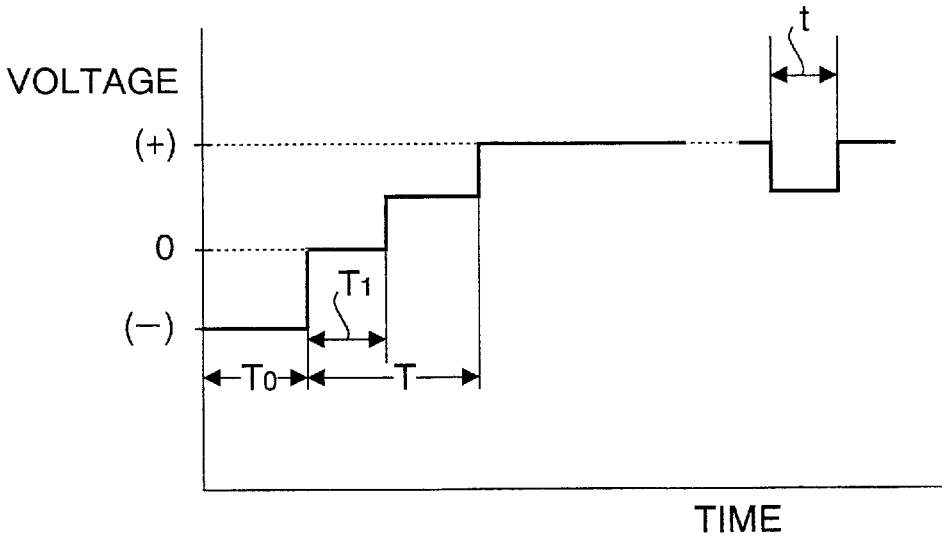
FIG. 3 illustrates a graph showing how the voltages applied to the transfer roller are changed.

The cleaning sequence for the transfer roller is performed under the conditions shown in the graph of FIG. 3. In this graph, the horizontal axis shows time and the vertical axis shows applied voltage. The voltage for the cleaning is set at −900V, and the transfer voltage is set in accordance with the temperature conditions shown in the graph of FIG. 2. As illustrated in FIG. 3, a cleaning sequence is set such that a voltage of −900V is applied to the transfer roller and kept for a predetermined period of time (T0) to clean the transfer roller. When the cleaning sequence is finished, the voltage is returned to the ordinary transfer voltage, and a predetermined transfer voltage is applied such that the photosensitive drum transfers the toner image to the recording sheet. When a series of recorded sheets are made in succession, the transfer voltage application is reduced for the period denoted as "t" that corresponds to the gap between tow successive recording sheets.

After the cleaning sequence, in order to go back to the step where ordinary transfer voltage is applied, a time setting T is created between the cleaning voltage application and the transfer voltage application, and an intermediary voltage is applied during the time setting T. Specifically, in the period T, for example, the intermediate voltage or 0V is applied for a duration of T1, and after the duration the predetermined transfer voltage is applied to the transfer roller 26. The time duration T1 is set so that the photosensitive drum 22 rotates once or twice during that time. Another intermediate voltage between the transfer voltage and 0V may be applied in order to alleviate the electrical shock given to the photosensitive drum. The aforesaid additional intermediate voltage application may be omitted.

To apply the intermediate voltage as is shown in FIG. 3, a transfer voltage control unit 30 is installed for the transfer roller 26, as is shown in FIG. 1, so that a pre-set amount of voltage is applied to the transfer roller 26. The intermediate voltage control unit 30 includes a control circuit 31, a voltage application circuit 32 that applies voltage to the transfer roller under control of the control circuit 31, a memory 33 that stores setting conditions for the temperature and voltage for the control circuit 31, and a control table 34 that is used for setting the control conditions. In addition, a sensor 35 is installed to measure the temperature inside the image forming apparatus at a certain position. The temperature detected by the sensor 35 is input into the control circuit 31 so that transfer voltages can be adjusted whenever necessary in accordance with the temperatures within the apparatus.

The transfer voltage control unit 30 actuates the cleaning sequence in accordance with the conditions set in the main control unit of the image forming apparatus when it is detected that a preset number of recorded sheets have been made. During the cleaning sequence, the paper feed is stopped, and other voltage applying mechanisms for the photosensitive drum 22 including the charging roller 24 are stopped while a cleaning voltage of −900V is applied to the transfer roller. After the cleaning voltage is maintained for the time T0, while setting for ordinary voltage application to the charging roller 24 and the developing roller 14, the ordinary transfer voltage is applied to the transfer roller 26. During the process of applying the transfer voltage to the transfer roller, the time duration T is set during which intermediate voltages are applied. As is mentioned before, during the process of intermediate voltage application, 0V may be maintained during the whole duration of the time T.

Figure 4:
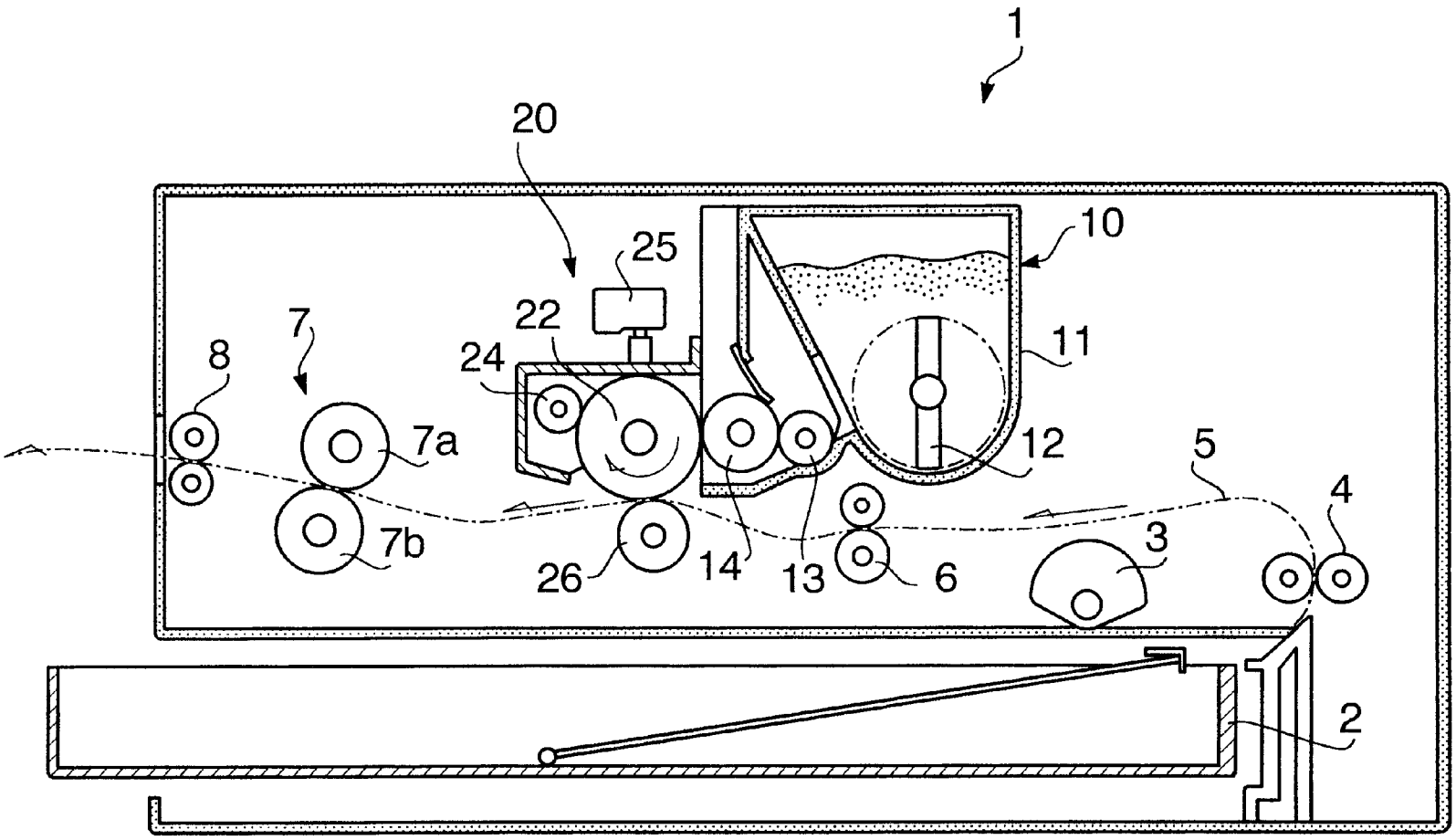
FIG. 4 is an illustrative diagram of an image forming device employing said photosensitive unit.

The method of changing the voltage applied to the transfer roller 26 may be incorporated in an apparatus shown in FIG. 4 where an image forming apparatus is combined with other mechanisms. The image forming apparatus 1 shown in FIG. 4 can be combined with an image scanning apparatus to create an electrophotographic copy machine, or with a personal computer interface to create a printer, or with an image scanning apparatus as well as a facsimile-sending/receiving apparatus to create a facsimile machine, or a combined machine where several functions are combined.

In the image forming apparatus 1 shown in FIG. 4, a pick-up roller 3 located in the feed section of the paper feed tray 2 sends recording sheets one by one. Paper feed roller mechanisms 4 and 6 send the recording sheets along a paper feed passage 5. While the recording sheets go between the photosensitive drum 22 and the transfer roller 26, a toner image formed on the photosensitive drum 22 is transferred. The recording sheet on which the toner image is transferred, goes on between the heat roller 7*a* of the fixing unit 7 and the nip roller 7*b* to be fixed and discharged to the unloading tray by a pair of discharging rollers 8. In the above-mentioned image forming apparatus 1, image information supplied to the exposure member 25 is provided from an image scanner (not shown) which is used in combination with the image forming apparatus 1, or from digital signals received from a remote facsimile machine. The formation of image on the photosensitive body is done through light emitted from LED elements of said exposure member 25.

It should be noted that the described and illustrated embodiment may be modified in various ways. For instance, a belt-type photosensitive body may be used instead of a photosensitive drum. If said belt-type photosensitive body is used, the duration of the voltage application for the cleaning sequence, and the duration of the intermediate voltage may be set differently from the duration in the case of the photosensitive drum. The conditions for the applied voltage for the transfer roller naturally need to be varied depending on the structure of the image forming apparatus and especially of the fixing unit, which has a great impact on the temperature fluctuation within the apparatus. These conditions will be set depending on the basic structure of the image forming apparatus.

What is claimed is:

1. An image forming apparatus comprising:

a photosensitive body;

a contact-transfer member that contacts said photosensitive body;

a voltage applying circuit that applies voltage to said contact-transfer member; and a sensor adapted to detect a temperature inside the image forming apparatus;

a controller, responsive to the temperature detected by the sensor, adapted to cause the voltage applying circuit to apply voltage, opposite in polarity to that used for transferring, to the contact-transfer member so as to perform a cleaning sequence that causes residual toner and paper particles on the contact-transfer member to return to the photosensitive body, and adapted to cause the voltage applying circuit to apply intermediate voltage of approximately zero volts to the contact-transfer member in the course of a switch from the voltage used for the cleaning sequence to the voltage used for the transferring, and wherein the controller adjusts the voltage based on the temperature detected by the sensor.

2. The image forming apparatus as in claim 1, wherein the photosensitive body is a photosensitive drum, the control unit causes the voltage applying circuit to apply the intermediate voltage of approximately zero volts to the contact-transfer member during a period in which the photosensitive drum rotates once or twice.

3. The image forming apparatus as in claim 1, wherein the intermediate voltage of approximately zero volts is applied at least once.

4. The image forming apparatus as in claim 2, wherein the intermediate voltage of approximately zero volts is applied at least once.

5. An image forming apparatus comprising:

a photosensitive body;

a charging member that charges a surface of said photosensitive body;

an exposing unit that forms an electrostatic latent image on the charged surface of said photosensitive body;

a developer that develops said electrostatic latent image on said photosensitive body with a toner;

a contact-transfer member that contacts said photosensitive body and transfers the toner from said photosensitive body onto a recording sheet;

a memory removing member that stirs residual toner that remains on the photosensitive body without being transferred, so that adhesion strength of the toner to the photosensitive body is weakened;

a voltage applying circuit that applies voltage to said contact-transfer member;

a recording sheet feeding mechanism that feeds recording sheets to a position between the photosensitive body and the contact-transfer member; and a sensor adapted to detect a temperature inside the image forming apparatus;

a control unit, responsive to the temperature detected by the sensor, adapted to cause the voltage applying circuit to apply voltage, opposite in polarity to voltage used for transferring, to the contact-transfer member when there is no recording sheet between the photosensitive body and contact-transfer member, so as to perform a cleaning sequence that causes the toner and paper articles on the contact-transfer member to return to the photosensitive body, and adapted to cause the voltage applying unit to apply intermediate voltage of approximately zero volts to the contact-transfer member in the course of a switch from the voltage used for the cleaning sequence to that used for the transferring, and wherein the control unit adjusts the voltage based on the temperature detected by the sensor.

6. The image forming apparatus claimed in claim 5, wherein said photosensitive body is a photosensitive drum, and the control unit causes the voltage applying unit to apply the intermediate voltage of approximately zero volts to the contact-transfer member while said photosensitive drum is rotating once or twice.

7. The image forming apparatus claimed in claim 5, wherein the intermediate voltage of approximately zero volts is applied at least once.

8. The image forming apparatus claimed in claim 6, wherein the intermediate voltage of approximately zero volts is applied at least once.

9. An image forming method comprising the steps of:

detecting a temperature;

applying a voltage, opposite in polarity to that used for transferring, to a contact-transfer member whenever there is no recording sheet between a photosensitive body and the contact-transfer member;

adjusting the voltage based on the temperature detected;

applying an intermediate voltage of approximately zero volts to the contact-transfer member;

applying a voltage used for the transferring to the contact-transfer member; and feeding a recording sheet between the photosensitive body and the contact-transfer member so that the toner image on the photosensitive body is transferred on the recording sheet.

10. The image forming method claimed in claim 9, wherein said photosensitive body is a photosensitive drum, and applying an intermediate voltage of approximately zero volts is executed while the photosensitive drum is rotating once or twice.

11. The image forming method claimed in claim 9, wherein the intermediate voltage of approximately zero volts is applied at least once in applying an intermediate voltage of approximately zero volts.

12. The image forming method claimed in claim 10, wherein the intermediate voltage of approximately zero volts is applied at least once in applying an intermediate voltage of approximately zero volts.

* * * * *